United States Patent [19]

Schiel

[11] 4,072,557

[45] Feb. 7, 1978

[54] METHOD AND APPARATUS FOR SHRINKING A TRAVELLING WEB OF FIBROUS MATERIAL

[75] Inventor: Christian Schiel, Heidenheim-Schnaitheim, Germany

[73] Assignee: J. M. Voith GmbH, Heidenheim (Brenz), Germany

[21] Appl. No.: 772,591

[22] Filed: Feb. 28, 1977

Related U.S. Application Data

[63] Continuation of Ser. No. 642,371, Dec. 19, 1975, abandoned.

[30] Foreign Application Priority Data

Dec. 23, 1974 Germany ..... 2461229

[51] Int. Cl.[2] ..... D21H 5/24; D21F 2/00

[52] U.S. Cl. ..... 162/111; 26/18.6; 162/207; 162/280; 162/307

[58] Field of Search ..... 162/111, 204, 205, 206, 162/207, 280, 290, 305, 306, 307, 358, 359, 360 R, 361; 26/18.6

[56] References Cited

U.S. PATENT DOCUMENTS

| | | | |
|---|---|---|---|
| 1,701,226 | 2/1929 | Collins | 162/306 X |
| 2,730,933 | 1/1956 | Reynolds | 162/307 X |
| 3,355,350 | 11/1967 | Reynolds | 162/358 |
| 3,359,156 | 12/1967 | Freuler et al. | 26/18.6 X |

FOREIGN PATENT DOCUMENTS

| | | |
|---|---|---|
| 1,611,758 | 8/1973 | Germany. |
| 1,212,473 | 11/1970 | United Kingdom. |

*Primary Examiner*—Richard V. Fisher
*Attorney, Agent, or Firm*—Herbert L. Lerner

[57] ABSTRACT

Method and apparatus for shrinking a travelling web of fibrous material by transferring the web of fibrous material on a porous carrier web to a transfer web travelling at a lower velocity than the carrier web, curving the carrier web to a convex curvature toward the transfer web, at the transfer area, and employing a differential pressure to aid in the transfer of the web of fibrous material to the transfer web. Transversal shrinking is also accomplished by deviating the travel direction of the transfer web in the transfer area laterally at an acute angle from the travel direction of the carrier web. The fibrous material may also be transferred to a second transfer web which may also be at a lateral angle to effect transversal shrinking.

10 Claims, 5 Drawing Figures

Fig. 1
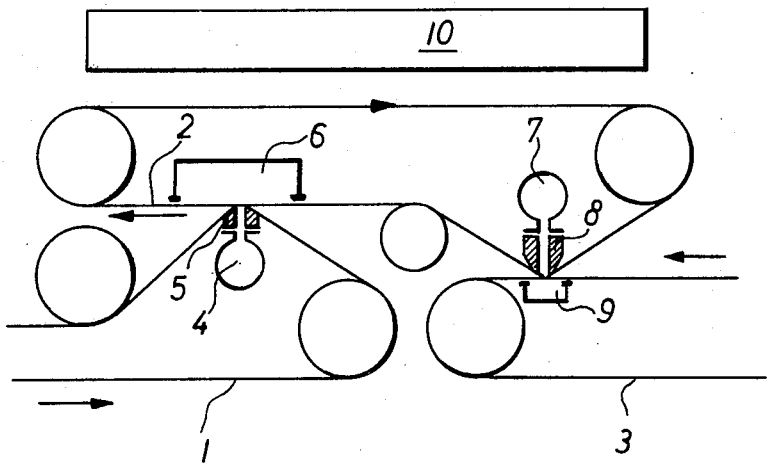
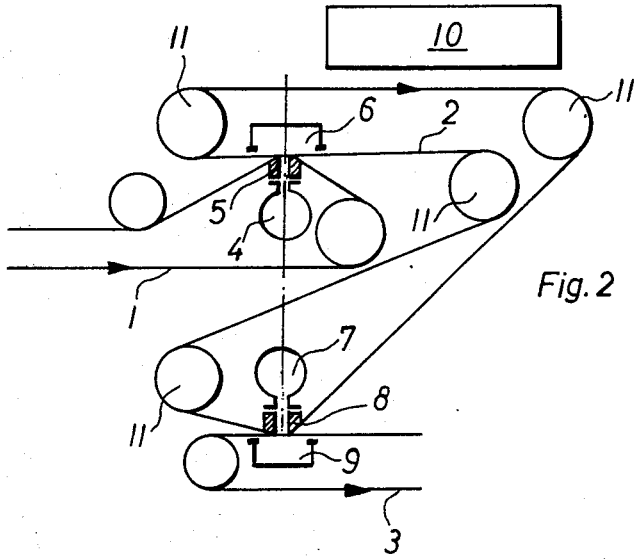
Fig. 2
Fig. 3
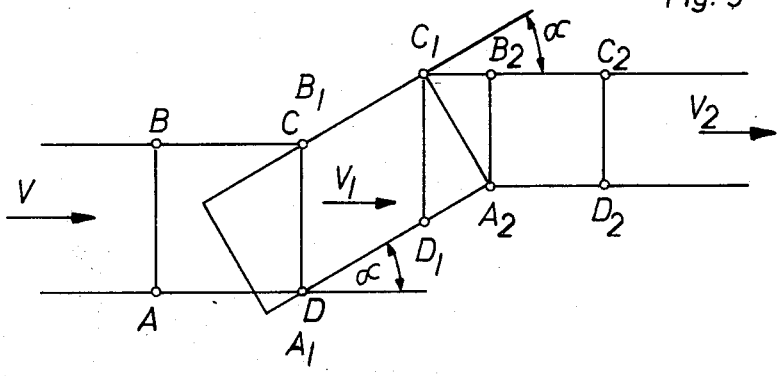

Fig. 4
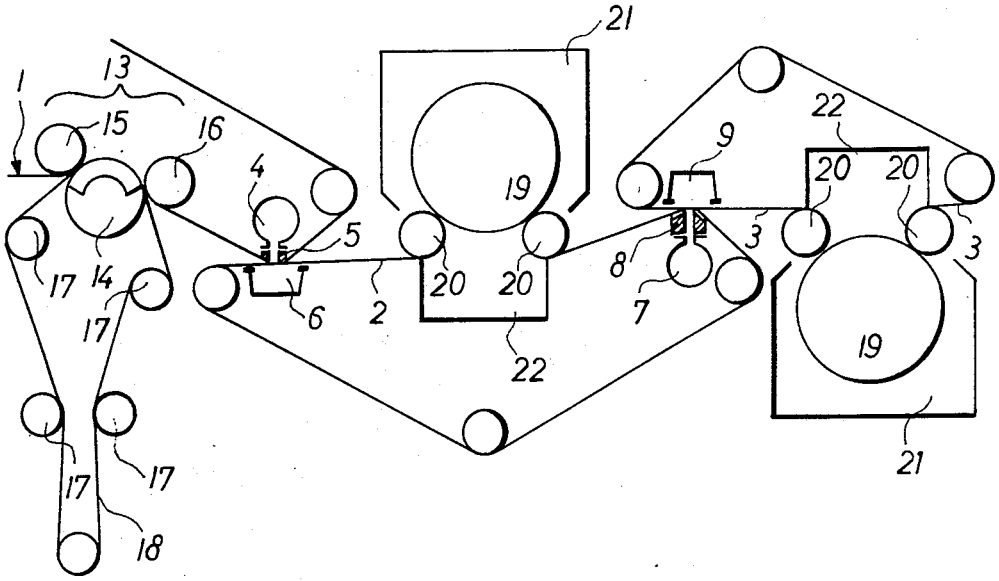
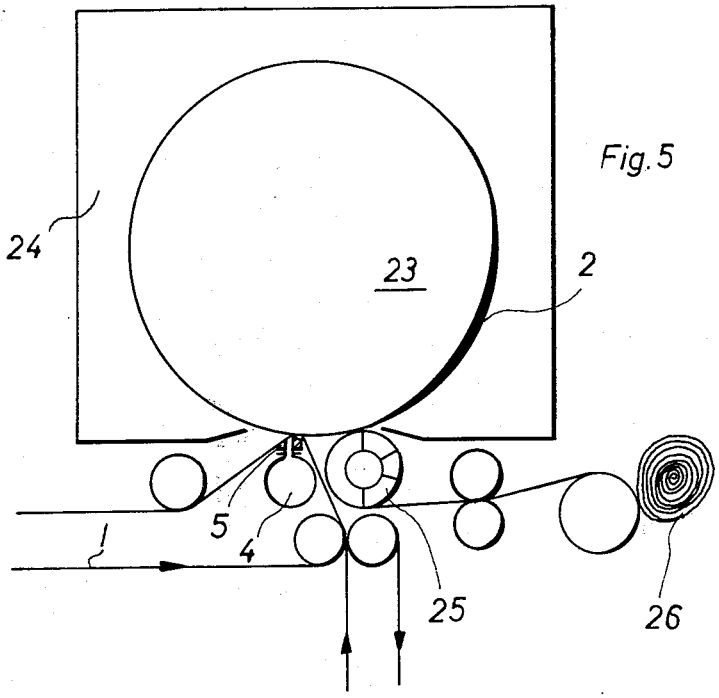
Fig. 5

METHOD AND APPARATUS FOR SHRINKING A TRAVELLING WEB OF FIBROUS MATERIAL

RELATED APPLICATION

This application is a continuation of application Ser. No. 642,371, filed on Dec. 19, 1975 and now abandoned.

This invention relates to a method and apparatus for shrinking a travelling web of fibrous material and more particularly refers to a new and improved method and apparatus for effecting longitudinal and transverse shrinking of the fibrous material.

Shrinking or upsetting of travelling paper webs in the longitudinal direction is used to give to the paper in this direction greater ductility, more softness, more fluffiness or more absorbing power. Basically, two methods are known for this purpose: In the one of them, a shrinking arrangement is used which employs a cylinder of hard material as well as a pressure cloth of elastic material cooperating with the former as described in German Auslegeschrift 1,611,758. The other method is creping, where the moist web is first laid onto the surface of a cylinder and is then shaved off by means of a scraper blade.

Both methods have the disadvantage that they can be carried out only with webs of high strength. This means that the webs must either have very long fibers and be thick, or must be first dried fairly well. Also, shrinking transversely to the travel direction of the web is not possible by these methods. In the first-mentioned method, the amount of machinery required as well as the expenditure due to the wear of the pressure cloth are rather large. Creping meets present-day requirements the least, as a very coarse wave structure is generated thereby. Dry-creping has the further disadvantage of greatly reducing the strength.

An object of the invention is to provide a method and apparatus for shrinking a travelling web of fibrous material at a reduced cost and/or improved quality of product. Another object of the present invention is to provide a method and apparatus for shrinking very thin and very moist webs.

With the foregoing and other objects in view, there is provided in accordance with the invention, a method of shrinking a travelling web of fibrous material which comprises moving said web of fibrous material disposed on a porous carrier to an area adjacent a moving transfer web for transfer of said web of fibrous material to said transfer web, maintaining the velocity of said moving transfer web lower than the velocity of said moving porous carrier, maintaining said porous carrier in a convex curvature toward the transfer web in the transfer area, and maintaining a pressure differential between the pressure at the underside of said porous carrier and the topside of said web of fibrous material to aid in the transfer of said web of fibrous material to said transfer web.

Apparatus, in accordance with the invention, for shrinking a travelling web of fibrous material comprises a porous carrier web for conducting a web of fibrous material, a transfer web for receiving said web of fibrous material, means for driving said porous carrier web to a transfer area adjacent said transfer web for transfer of said web of porous material, means for driving said transfer web at a velocity lower than the velocity of said porous carrier web, support means for said porous carrier web in said transfer area to effect a convex curvature toward the transfer web of said porous carrier web and means for maintaining a pressure differential between the pressure at the underside of said porous carrier and the topside of said web of fibrous material to aid in the transfer of said web of fibrous material to said transfer web.

In accordance with a further feature of the invention, transversal shrinking may be effected by a method of shrinking a travelling web of fibrous material which comprises moving said web of fibrous material to an area adjacent a moving transfer web for transfer of said web of fibrous material to said transfer web, and deviating in said transfer area, the travel direction of said transfer web laterally at an acute angle from the travel direction of said carrier web to effect transversal shrinking of said web of fibrous material.

In a further modification, the web of fibrous material is transferred from said transfer web to another transfer web and the travel direction of said second transfer web deviates laterally from the travel direction of said first transfer web at an acute angle to the other side.

The problem of shrinking thin and moist webs is solved by the combination of the following features:

a. The web of fibrous material is brought by a porous carrier web, preferably a felt, to a transfer web, preferably a screen, and transferred to the latter;
b. the transfer web is driven toward the carrier web with somewhat lower velocity;
c. the carrier web has a convex curvature toward the transfer web, as seen from the side;
d. a pneumatic differential pressure is made to act on the web of fibrous material in the transfer zone to aid in the transfer.

The shrinking process proper is initiated by features *a*) and *b*). These features cause a deceleration of the web of fibrous material at the instant of the transfer. However, provision must be made that the web of fibrous material is fixed at the transfer web. The problem here is the following: In being fixed, the web of fibrous material should be locked in place at the transfer web reliably and intimately enough so that it does not form excessively coarse waves or folds due to this deceleration. On the other hand, this fixation should be accompanied by some elasticity, so that the fiber structure is not destroyed. Features *c*) and *d*) have been found to be highly successful for this purpose. Feature *c*) causes the centrifugal force to act on the web of fibrous material to induce this fixation. The centrigugal force has here as is desired, a greater fixation effect, with higher speeds of the machine. In addition, the fixation force can be apportioned very sensitively by feature *d*). In practice a velocity of the transfer web of 0.5 to 0.97 times the velocity of the carrier web has been found satisfactory. In treating paper for hygiene purposes, the difference is larger and in the case of wrapping paper, smaller.

The method according to the invention can be applied to moist or dry webs of fibrous material. Best results are obtained with a dry content of between 10 and 50%, preferably with a dry content of 30%. The contact zone for web transfer, as seen in the travel direction, should desirably be very short. The radius of curvature should therefore preferably be accordingly small in the transfer zone, e.g., five centimeters or less. Expressed in very general terms, the longitudinal extent of the contact zone should desirably be made so that the difference in travel distance between the two webs is still in the range of the averge fiber length of the web of fibrous material. With an average fiber length of 1 mm and 10% shrinkage, for instance, a length of the contact zone of not more than $(1 \times 100/10) = 10$ mm is desired. The shorter the contact zone in the transfer region, the less danger there is that the web of fibrous material in stressed unevenly during the transfer with consequent less damage to the web and retention of its strength. As a practical value for the contact zone, as measured in the travel direction, 20 mm or less should be chosen. Generally, this would be adequate for treating a web with a fiber length of 1 mm and 5% shrinkage.

It is known to transfer a web fibrous material from a paper-making machine screen to a succeeding pressure felt cloth and to use a so-called suction pickup device for vacuum in the transfer zone. However, such a device does not serve the purpose of shrinking. The velocity of the transfer web is generally higher than that of the carrier web. Also, the carrier web is not of a convex curvature in the transfer zone but, just the reverse, the transfer web is curved. In an important embodiment of the invention, the travel direction of the transfer web, as seen in a top view, deviates slightly from the travel direction of the carrier web. In this manner shrinking of the web of fibrous material in the transversal direction is obtained. The problem of transversal shrinking is thereby solved for the first time. Transversal shrinking can be achieved also if, for instance, the carrier web and the transfer web have exactly the same velocity. Through the angle deviation mentioned, a rectangular fiber web element which is brought along on the carrier web, is distorted on the transfer web in the manner of a parallelogram. Isotropic alignment can be achieved by repeating exactly the same with a further transfer web by letting this final transfer web deviate in the travel direction toward the opposite side. The webs are best arranged so that the carrier web and the final transfer web run parallel to each other. According to a particularly advantageous embodiment, the transfer web which is disposed between the carrier web and the final transfer web is arranged here so that the two transfer zones are located vertically one above the other.

Other features which are considered as characteristic for the invention are set forth in the appended claims.

Although the invention is illustrated and described herein as embodied in method and apparatus for shrinking a travelling web of fibrous material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which:

FIG. 1 diagrammatically illustrates one embodiment of the invention as viewed from the side, for transferring a web from a carrier web to a transfer web and then to a final transfer web;

FIG. 2 is a modification of FIG. 1 with the transfer zones arranged one above the other;

FIG. 3 diagrammatically illustrates transfer of a web on a carrier web to a transfer web travelling an intermediate path at an angle to the carrier web;

FIG. 4 diagrammatically illustrates the method of shrinking in the area of the pressing and drying portion of a paper-making machine; and FIG. 5 diagrammatically illustrates transfer of a web to a screen stretched over a suction cylinder.

Referring to FIG. 1 a web of fibrous material, not shown, is transferred from a carrier web 1 to a transfer web 2 and from there, to a final transfer web 3. In the first transfer zone, a blow pipe 4 with a slit nozzle 5 as well as a suction box 6 are provided. In the second transfer zone, a blow pipe 7 with a blower slot 8 and the suction device 9 are arranged. The arrows indicate the travel direction of the individual webs. A drier 10 such as an air blast, radiation or ventilating air drier is associated with transfer web 2.

In FIG. 2, the same elements are shown as in FIG. 1, but in a somewhat different arrangement, with a rotatable transfer web 2. The two transfer zones are arranged here in one and the same plane. The two blasting nozzles 5 and 8 or their exit slots lie in this plane vertically one above the other, as can be seen in the illustration. As a result the transfer web is deflected in such a manner that it travels in exactly the opposite direction in the two transfer zones. This arrangement has the following advantage that belt 2 with all accessories associated with it (guide rolls 11, suction box 6, blowpipe 7 with nozzle 8) can be rotated to deviate by an angle, so that this transfer web, as seen in a top view, is no longer parallel to the carrier web 1 and to the final transfer web 3. The axis of rotation is advantageously placed here in the mentioned plane, shown by the dot-dash line in the drawing. With such an arrangement, the angle between the carrier web 1 and the transfer web 2 is exactly the same as the angle between the transfer web 2 and the final transfer web 3, but the deviation in the first transfer zone is to one side, while it is to the other side in the second transfer zone. This has the advantage that transversal shrinking is accomplished twice, producing an isotropically shrunk web of fibrous material. It has the further advantage that the carrier web 1 and the final transfer web 33 are aligned with each other and are therefore not laterally displaced from one another, as seen from the top, in spite of the two deviations at the two transfer zones.

In FIG. 3, a surface element of the fibrous material web, such as is brought along on the carrier web, is shown as the square A, B, C, D. Along the distance B-C, the surface element is transferred to an intermediate path at an angle $\alpha$ to the carrier web, which travels with the velocity $v_1/\cos\alpha$. The area of the web shrinks in the process to the amount $v_1/v$, the base lines AB and CD remaining equally long. Angle $\alpha$ is preferably an acute angle less than 45° and desirably within the range of 5° to 30°.

The surface element on the intermediate path now has a trapezoidal shape with the corners $A_1$, $B_1$, $C_1$ and $D_1$. By a transfer device acting along the line $C_1$-$A_2$, the web of fibrous material is transferred to the transfer web and assumes there the shape of the quadrangle $A_2$, $B_2$, $C_2$, $D_2$. If $v_2 = v_1$ is chosen, this quadrangle is a rectangle; if in addition, $v_1/v = \cos^2\alpha$ is chosen, then the surface element $A_2$, $B_2$, $C_2$, $D_2$ is again a square. Isotropic shrinking by the same amounts in all directions of the plane is therefore obtained by means of such an operating procedure, not attained by any method heretofore.

FIG. 4 shows an application of the described shrinking method in the area of the pressing and drying portion of a paper-making machine. On the underside of a carrier web 1, a web of fibrous material, not shown, is transported to a wet press 13, which comprises a suction cylinder 14, two pressure cylinders 15 and 16 as well as guide cylinders 17 and bottom felt 18. After passing through the press, the fibrous material web hanging below carrier web 1 is transferred from carrier web 1 to a transfer web 2 in a transfer zone, aided by blow pipe 4 with slit nozzle 5 and suction box 6.

The web of fibrous material is thereupon conducted through a drying portion which comprises, among other things, a suction cylinder 19 provided with a perforated surface, guide cylinders 20, a hood 21 and a suction box 22. The web of fibrous material is then passed from the transfer web 2, in a second transfer zone, to a final transfer web 3, again using a blowpipe 7 with a blow nozzle 8 and suction box 9. A further drying arrangement, of similar design as the first-mentioned one follows.

In the apparatus shown in FIG. 5, a web of fibrous material is transferred from a carrier web 1 to the periphery of a suction cylinder 23 by means of transfer device 4, 5. A screen 2 is stretched over the periphery of this suction cylinder. The suction cylinder is enclosed by a hot-air blower hood 24. Here, too, a differential velocity is established between carrier web 1 and the transfer web 2., since the suction cylinder rotates with a somewhat lower circumferential velocity than that with which the carrier web revolves. The web of fibrous material, after running off suction cylinder 23, is led via a suction cylinder 25 to a rolling device 26.

There is claimed:

1. Method of shrinking a travelling web of fibrous material which comprises moving said web of fibrous material disposed on a porous carrier web to an area adjacent a moving transfer web for transfer of said web of fibrous material to said transfer web, maintaining the velocity of said moving transfer web lower than the velocity of said moving porous carrier, maintaining said porous carrier in a convex curvature toward the transfer web in the transfer area, and maintaining a pressure differential between the pressure at the underside of said porous carrier and the topside of said web of fibrous material by gas under pressure in the transfer area acting on the web of fibrous material, said gas under pressure emanating from a fixed position on the side of the carrier web opposite the side carrying the web of fibrous material, to aid in the transfer of said web of fibrous material to said transfer web.

2. Method according to claim 1, wherein the travel direction of the transfer web deviates laterally at an angle from the travel direction of the carrier web.

3. Method according to claim 2 wherein said web of fibrous material is transferred from said transfer web to a second transfer web and the travel direction of said second transfer web deviates laterally from the travel direction of the transfer web at an angle to the other side.

4. Method according to claim 3 wherein said angle deviations are about of the same magnitude.

5. Apparatus for shrinking a travelling web of fibrous material comprising a porous carrier web for conducting a web of fibrous material, a transfer web for receiving said web of fibrous material, means for driving said porous carrier web to a transfer area adjacent said transfer web for transfer of said web of fibrous material, means for driving said transfer web at a velocity lower than the velocity of said porous carrier web, support means for said porous carrier web in said transfer area to effect a convex curvature toward the transfer web of said porous carrier web and a blasting device through which gas under pressure is applied, fixedly positioned on the side of the carrier web opposite the side carrying the web of fibrous material, for maintaining a pressure differential between the pressure at the underside of said porous carrier and the topside of said web of fibrous material to aid in the transfer of said web of fibrous material to said transfer web.

6. Apparatus according to claim 5 including a suction device in the transfer area on the side of said transfer web which is facing away from said carrier web.

7. Apparatus according to claim 5 wherein said transfer web in said transfer area is disposed laterally to travel in a direction at an acute angle to the travel direction of said carrier web.

8. Apparatus according to claim 7 including a second transfer web for transfer of said web of fibrous material from said first transfer web, said second transfer web being disposed laterally to travel in a direction at an angle to the travel direction of said first transfer web and parallel to the travel direction of said carrier web.

9. Apparatus according to claim 8 wherein means are provided for adjusting said angles.

10. Apparatus according to claim 8 wherein said transfer area between said first transfer web and said carrier web and the transfer area between said first transfer web and said second transfer web are located vertically one above the other.

* * * * *